United States Patent [19]

Mühling

[11] Patent Number: 5,015,922

[45] Date of Patent: May 14, 1991

[54] POWER SUPPLY CIRCUIT FOR A GAS DISCHARGE LAMP

[75] Inventor: Rudolf Mühling, Gebenstorf, Switzerland

[73] Assignee: Ultralight AG, Liechtenstein, Liechtenstein

[21] Appl. No.: 332,280

[22] PCT Filed: Jul. 20, 1988

[86] PCT No.: PCT/EP88/00652

§ 371 Date: Mar. 9, 1989

§ 102(e) Date: Mar. 9, 1989

[87] PCT Pub. No.: WO89/00804

PCT Pub. Date: Jan. 26, 1989

[30] Foreign Application Priority Data

Jul. 20, 1987 [DE] Fed. Rep. of Germany ..... 3723971

[51] Int. Cl.[5] ..... H05B 41/18

[52] U.S. Cl. ..... 315/282; 315/284; 315/291; 315/244

[58] Field of Search ..... 315/244, 282, 284, 291, 315/306, DIG. 4, 241 R

[56] References Cited

U.S. PATENT DOCUMENTS 4,695,771 9/1987 Hallay ..... 315/244
4,929,871 5/1990 Gerfast ..... 315/244

FOREIGN PATENT DOCUMENTS 2816715 10/1978 Fed. Rep. of Germany ..... 315/282
2426382 1/1980 France ..... 315/284

*Primary Examiner*—Eugene R. LaRoche
*Assistant Examiner*—Son Dinh
*Attorney, Agent, or Firm*—Brooks, Haidt, Haffner & Delahunty

[57] ABSTRACT

A power supply circuit for an electric discharge lamp driven by an A.C. power supply has a regulating transformer connected in parallel with a current limiting reactor and an electric discharge lamp interconnected in series. The tap of the regulating transformer is connected by a condenser and an auxiliary reactance interconnected in series to the connection between the current limiting reactor and the electric discharge lamp. By adjusting the tap of the regulating transformer the performance of the lamp can be influenced within a wide range. In place of the regulating transformer an electronic phase shifter may also be used, which is particularly advantageous when regulating speeds are required that cannot be achieved by means of an electromechanically adjustable regulating transformer.

3 Claims, 1 Drawing Sheet

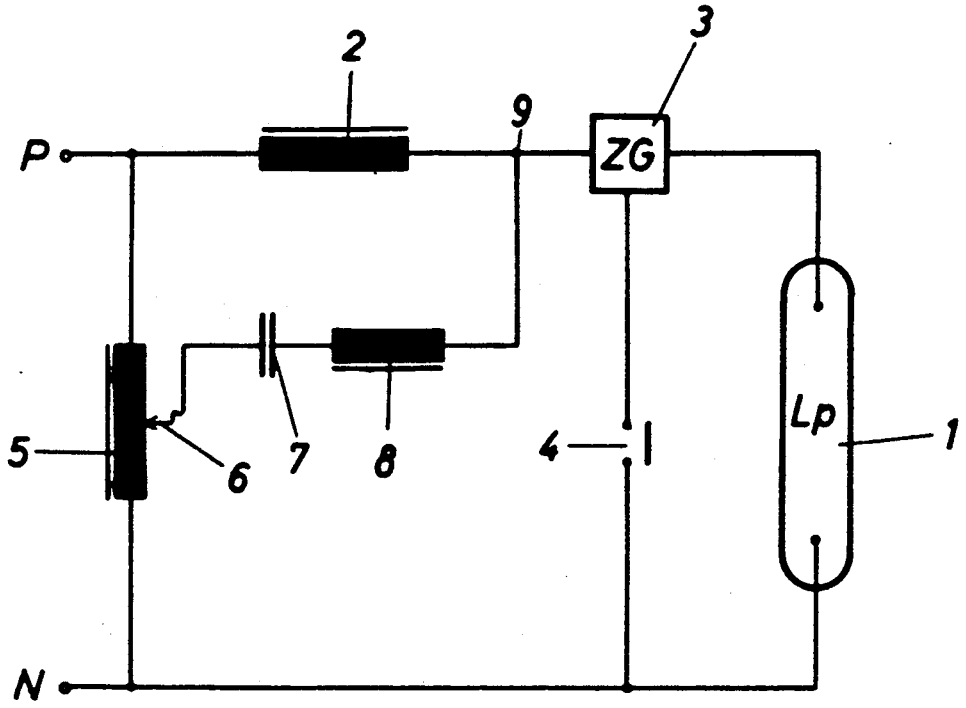
2
3
9
P
ZG
Lp
1
5
6
7
8
4
N

POWER SUPPLY CIRCUIT FOR A GAS DISCHARGE LAMP

The invention relates to power supply circuit for a gas discharge lamp operated at an a-c power source according to the preamble of claim 1. Power supply circuits of this type are generally known.

Gas discharge lamps show a non-linearity between the discharging current (lamp current) and the lamp voltage. The lamp voltage is a magnitude characteristic of the lamp and independent of the lamp current in a broad range. However, it becomes apparent that in the case of lamps with small output the voltage decreases somewhat with increasing current intensity. This makes the use of current limiting measures necessary to protect the lamp against destruction. In the case of lamps with great output the lamp voltage slightly increases with increasing lamp current. Small changes in the supply voltage ensue consequently in great changes in current so that in this case current-limiting measures are also necessary for stabilization.

Such current-limiting measures implemented in so-called chokes consist in gas discharge lamps fed from the a-c power line mostly essentially of a current-limiting reactor, which is connected in series with the lamp and produces a drop in voltage which should amount to about one third to one half of the mains voltage. Since the lamp acts roughly as resistive load, this drop in voltage is phase shifted by about 90° with respect to the lamp voltage.

If the mains current of a gas discharge lamp is to be adjustable, a variation of the supply voltage comes only consideration to a very small degree because in the case of an optimized lamp circuit it has only a very limited influence on the mains current. The requirement that the instantaneous supply voltage must be greater than the arc drop of the lamp to avoid an extinction of the lamp sets limits to controllability. Therefore, in practice, the control is effected in the choke itself. Continuous lamp current adjustments in the partial load range are implemented by means of phase-controllable circuits or with transductors, therefore the choke must be correspondingly designed right from the beginning. In the high-load range one resorts to parallel or series connections of current-limiting reactors which makes a control only in relatively coarse steps possible if the expenditure should not become too great. It is in particular. stated with respect to phase-controllable circuits that the same produce a broad harmonics spectrum which is undesired for the lamp.

The invention is based on the object to indicate a power supply circuit of the type indicated at the beginning with which the power input of a gas discharge lamp can be adjusted in a broad range whose limits are in a ratio of up to about 3:1 to each other.

The invention thus extends the known power supply circuit by three additional components, namely by a regulating transformer, a capacitor and an auxiliary reactor, it being possible to design the auxiliary reactor to a small output as compared with the current-limiting reactor, and the regulating transformer must also only be designed for a correspondingly small output in accordance with the auxiliary current circuit consisting of the auxiliary reactor and the capacitor. The regulating transformer may be of a commercially available construction which is adapted to the supply mains voltage.

The current flowing in the auxiliary current circuit, i.e. in the auxiliary branch, is dependent only on the voltage at the auxiliary current circuit, i.e. in the minimum position of the transformer tap on the lamp voltage and in the maximum Position on the voltage via the current-limiting reactor. Depending upon the fact whether the lamp voltage or the voltage via the current-limiting reactor is larger, the current flowing in the auxiliary branch will also be higher or smaller in the minimum or maximum position. If the current and voltage nominal values of the auxiliary reactor are achieved, the auxiliary branch is optimally dimensioned. Therefore one cannot select optional capacitance values; if they are too high, the auxiliary reactor is overloaded. Its maximum value is determined by the size of the auxiliary reactor.

The control range results from the apparent output in the auxiliary branch which is determined by the sum of vectors of the apparent outputs of capacitor and auxiliary reactor.

It is a special advantage of the invention that the mentioned additional components can be subsequently added to an existing choke of a gas discharge lamp without having to exchange any components in the choke or to open any line connections. Therefore it is possible to subsequently connect the control circuit embodied by the invention with a simple plug connection being only three-pole in the borderline case (and four-pole including a mass connection conductor) to the existing choke or to also separate it again from the same without impairing its customary operativeness.

Since a voltage is effective at the control transformer at the lamp in the "maximum" position of the tap, which is higher than the customary voltage output by the current-limiting reactor, the entire arrangement advantageously ignites more rapidly. A so-called step-up transformer which is often required in the case of higher lamp voltages can therefore possibly be avoided by using the invention. In the borderline case, if a control of the lamp output can be renounced such a replacement of a step-up transformer consists only of the auxiliary reactor and the capacitor of the auxiliary branch as will be explained in the following.

A further advantage of the invention consists in still improving the sine character of the current flowing through the lamp, which is of course beneficial for lamps.

The invention is explained in more detail in the following with reference to the drawing.

The drawing shows a gas discharge lamp (Lp) 1 with a current-limiting reactor 2 connected in series to an a-c power supply mains, whose poles are designated with P and N. An ignition device ZG) 3 may possibly be disposed in known fashion between the current-limiting reactor 2 and the lamp 1, which is connected to the other pole N of the power mains via an ignition switch 4. The current-limiting throttle is customarily dimensioned taking the lamp voltage, the mains voltage and the lamp output into consideration so that special statements on this are superfluous here.

A regulating transformer 5 is connected in parallel to the inputs of the aforementioned lamp circuit which is connected to the poles P and N of the power mains, which has a movable tap 6, which is connected to a series connection of a capacitor 7 and an auxiliary reactor 8. The other end of this series connection is connected with the connection point 9 between lamp 1 and current-limiting reactor 2 (or in the case of an interposed ignition device between reactor 2 and ignition device 3).

The capacitance and the inductance of capacitor 7 and auxiliary reactor 8 are coordinated in such fashion that the reactance of the capacitor 7 is approximately 1.3 to 2.6 times higher than that of the auxiliary reactor 8. The ratio of these reactances to each other has a noticeable influence on the magnitude of the control range which can be achieved with the control circuit embodied by the invention. This will be dealt with in the following.

The auxiliary reactor 8 is dimensioned in such fashion with respect to the current-limiting reactor 2 that its reactance is about 1.5 to 5 times higher that of the current-limiting reactor 2. The smaller reactances require higher capacitor values to achieve comparable control range widths.

In the following test results obtained with the invention are summarized in tabular form.

Measurements were carried out in the auxiliary branch using capacitors of different sizes with a mercury vapour high-pressure lamp with an output of 400 W, a so-called 400 watt current limiting reactor with a reactance of about 44 Ωwith 50 Hz mains frequency and a so-called 250 W auxiliary reactor of a reactance of about 90 Ω or, in a second test series, of a reactance of about 225 Ω. The mains voltage was in all cases 230 V. The lamp voltage and the lamp current and the relative mains current were i.a. in each case measured in the minimum position and the maximum position of the tap 6 at the regulating transformer 5 and the lamp output was calculated. As compared to this, a measurement without regulating transformer and without auxiliary branch was carried out. The obtained values are indicated in the following table.

| Tap position at 5 | $U_L$ (V) | $I_L$ (8A) | $N_L$ (W) | E scale mark. | Cap. 7 (μF) | Aux. react. 8 (Ω) |
|---|---|---|---|---|---|---|
| min. | 108 | 2.17 | 232 | 12 | 20 | 90 |
| max. | 113 | 4.78 | 592 | 48 | (= 160Ω) | |
| min. | 113 | 3.18 | 359 | 27 | 12 | 90 |
| max. | 121 | 4.39 | 531 | 44 | (= 265Ω) | |
| min. | 110 | 2.67 | 294 | 19 | 10 | 225 |
| max. | 123 | 4.57 | 562 | 47 | (= 318Ω) | |
| min. | 113 | 3.16 | 357 | 27 | 8 | 225 |
| max. | 122 | 4.45 | 543 | 46 | (= 398Ω) | |
| min. | 116 | 3.55 | 412 | 36 | 6 | 225 |
| max. | 121 | 4.32 | 522 | 43 | (= 530Ω) | |
| without | 120 | 4.12 | 494 | 42 | — | — |

In this table $U_L$ means the voltage at the lamp 1

$I_L$ means the lamp voltage $N_L$ means the calculated lamp output

E means the relative mains current in scale markings (scale mark.) of a linear scale It can be gathered from the table that the lamp output can be varied by more than the factor 2, the width of the variation range depending decisively on the size of the capacitor 7 in relation to the reactance of the auxiliary reactor 8. The obtainable variation range increases with increasing capacitance, and it becomes apparent that for obtaining the said factor 2 the reactance of the capacitor 7 should not exceed 1.5 times that of the auxiliary reactor 8.

One can also see from the table that a higher lamp output is achieved in all cases in the maximum position of the tap at the regulating transformer in which the tap is at the potential of the N pole of the power mains and the regulating transformer is therefore ineffective for the auxiliary branch than in the case of a renunciation of the control circuit embodied by the invention as this is shown by the comparative example at the end of the table. If the regulating transformer and thus the controllability of the lamp output is renounced it is therefore still possible by means of the then remaining partial feature of the invention, namely the series connection of capacitor and auxiliary reactor in the auxiliary branch to achieve an increase in the lamp output without the use of a step-up transformer or without change at the current-limiting reactor.

It is understood that using a servo means the invention can also be used for levelling variations of the lamp output which might be caused by external influences or a decline in the mains current caused by lamp ageing.

An electronic phase shifter can be used in the circuit instead of a regulating transformer. Such a phase shifter is especially advantageous if control speeds are required which cannot be achieved with an electromechanically adjustable regulating transformer.

It is important that the phase shifter has a phase control range comparable to the control range of the regulating transformer within the circuit.

What is claimed is:

1. A power supply circuit for a gas discharge lamp operated at an AC power source containing a current-limiting reactor whose one end is connected to a connection of the gas discharge lamp, while its other (second) end and an other connection of the gas discharge lamp are adapted to be connected with the poles of the AC power source, and further comprising a regulating transformer connected in parallel to a series connection of the current limiting reactor and the gas discharge lamp having a tap connected to the connection point of current-limiting reactor and gas discharge lamp via a series connecting of a capacitor and an auxiliary reactor, the reactance of the capacitor being about 1.3 to 2.5 times the reactance of the auxiliary reactor.

2. A power supply circuit according to claim 1, characterized in that the reactance of the auxiliary reactor is about 1.5 to 5 times higher than the reactance of the current limiting reactor.

3. A power supply circuit according to claim 1, characterized in that the tap of the regulating transformer is adjustable between maximum and minimum positions, in which it is at the potential of the second connection (N) of the gas discharge lamp or at the potential of the second connection (P) of the current-limiting reactor.

* * * * *

UNITED STATES PATENT AND TRADEMARK OFFICE

CERTIFICATE OF CORRECTION

PATENT NO. : 5,015,922

DATED : May 14, 1991

INVENTOR(S) : Rudolph Muhling

It is certified that error appears in the above-identified patent and that said Letters Patent is hereby corrected as shown below:

Column 2, line 5,

"maximum Position" should read: --maximum position--.

Column 2, line 53,

"device ZG) 3" should read: --device (ZG) 3--.

Column 4, line 47,

"series connecting" should read: --series connection--.

Signed and Sealed this

Thirteenth Day of October, 1992

*Attest:*

DOUGLAS B. COMER

*Attesting Officer*

*Acting Commissioner of Patents and Trademarks*

UNITED STATES PATENT AND TRADEMARK OFFICE

CERTIFICATE OF CORRECTION

PATENT NO. : 5,015,922

DATED : May 14, 1991

INVENTOR(S) : Rudolph Muhling

It is certified that error appears in the above-identified patent and that said Letters Patent is hereby corrected as shown below:

In the Title Page:

"[73] Assignee: Ultralight AG, Liechtenstein, Liechtenstein"

should read:

--[73] Assignee: Ultralight AG, Schaanwald, Liechtenstein--.

Signed and Sealed this

Eighth Day of December, 1992

*Attest:*

DOUGLAS B. COMER

*Attesting Officer*

*Acting Commissioner of Patents and Trademarks*